US006892550B2

(12) United States Patent
Takemoto et al.

(10) Patent No.: US 6,892,550 B2
(45) Date of Patent: May 17, 2005

(54) ELECTRIC COMPRESSION DEVICE

(75) Inventors: Tsuyoshi Takemoto, Nukata-gun (JP); Toshinobu Homan, Obu (JP)

(73) Assignee: Denso Corporation, Kariya (JP)

( * ) Notice: Subject to any disclaimer, the term of this patent is extended or adjusted under 35 U.S.C. 154(b) by 75 days.

(21) Appl. No.: 10/630,018

(22) Filed: Jul. 30, 2003

(65) Prior Publication Data

US 2004/0020227 A1 Feb. 5, 2004

(30) Foreign Application Priority Data

Aug. 5, 2002 (JP) ..... 2002-227364

(51) Int. Cl.[7] ..... F25B 1/00; F25B 49/00
(52) U.S. Cl. ..... 62/229; 62/230; 62/228.1
(58) Field of Search ..... 62/229, 230, 228.4, 62/183, 259.2, 228.1

(56) References Cited

U.S. PATENT DOCUMENTS 6,523,361 B2 * 2/2003 Higashiyama ..... 62/228.4
6,688,122 B2 * 2/2004 Matsuoka ..... 62/134

FOREIGN PATENT DOCUMENTS

| | | |
|---|---|---|
| JP | 58-127038 | 7/1983 |
| JP | 8-284830 | 10/1996 |
| JP | 3086819 | 7/2000 |
| JP | 2002-51568 | 2/2002 |

OTHER PUBLICATIONS

Office Action dated Jul. 23, 2004 in corresponding Chinese Patent Application No. 03133054.1.

* cited by examiner

*Primary Examiner*—Chen Wen Jiang
(74) *Attorney, Agent, or Firm*—Harness, Dickey & Pierce, PLC

(57) ABSTRACT

An electric compression device has a motor section and a compressor section contained in a housing, an inverter attached to the outer surface of the housing, and a temperature measurement device for measuring a temperature of the inverter. In a stopped state of a refrigeration cycle system, a control unit drives the motor section when the temperature of the inverter, measured by the temperature measurement device, exceeds a predetermined temperature.

3 Claims, 5 Drawing Sheets

ELECTRIC COMPRESSION DEVICE

CROSS REFERENCE TO RELATED APPLICATION

This application is based upon, claims the benefit of priority of, and incorporates by reference, the contents of Japanese Patent Application No. 2002-227364 filed Aug. 5, 2002.

BACKGROUND OF THE INVENTION

1. Field of the Invention

The present invention relates to an electric compression device which is applicable to a vehicular refrigeration cycle device, such as an air conditioning system.

2. Description of the Related Art

As a conventional electric compression device, Japanese Patent No. 3086819 discloses an electric compression device in which a shell (a housing) contains a compressor section and a motor section. A power semiconductor module (an inverter) for driving a motor is attached to a wall of the shell so as to face a low pressure side inside the shell.

Accordingly, a low-temperature and low-pressure refrigerant, before being compressed by the compressor section, cools the power semiconductor module. Therefore, since a dedicated radiator plate, air blower, and the like become unnecessary, it is possible to reduce costs and reduce the size of the drive circuit.

When the electric compression device is stopped, however, the refrigerant does not cool down the power semiconductor module. When the electric compression device is used under high temperature conditions such as in a vehicle engine compartment, the temperature of the operating environment increases, and the increased heat from radiation causes damage in the power semiconductor module. To ensure proper resistance to heat, it is conceivable to make the size of the power semiconductor module large, or to use a power semiconductor module having a higher resistance to heat. However, these approaches are accompanied by an increase in costs.

SUMMARY OF THE INVENTION

In view of the foregoing problems, an object of the present invention is to provide an electric compression device in which an inverter can be cooled without affecting the environmental temperature.

To achieve the above object, the present invention adopts the following technical means. According to a first aspect of the present invention, an electric compression device has a motor section (110) driven by power output from an inverter (140); a compressor section (120) actuated by the motor section (110) to compress a refrigerant in a refrigeration cycle system; a control unit (102) for regulating output power of the inverter (140) to control the drive of the motor section (110); a housing (130) for containing the motor section (110) and the compressor section (120), the inverter (140) being attached to an outer surface of the housing (130); and a temperature measurement means (103) for measuring a temperature (Ti) of the inverter (140). When the refrigeration cycle system is stopped, the control unit (102) drives the motor section (110) when the temperature (Ti) of the inverter (140) measured by the temperature measurement means (103) exceeds a predetermined temperature (T1).

Since the motor section (110) actuates the compressor section (120) in accordance with the temperature (Ti) of the inverter (140) to cool the inverter (140) with the flowing refrigerant, the inverter (140) is unaffected by heat damage which is caused by an increase in environmental temperature. It is unnecessary to make the size of the inverter (140) large, or to use an inverter (140) having a higher resistance to heat, which makes it possible to reduce costs.

According to a second aspect of the invention, the housing (130) is provided with a temperature sensor (103*a* or 103*b*) for measuring a temperature of the motor section (110) or the compressor section (120). The control unit (102) converts the temperature measured by the temperature sensor (103*a* or 103*b*) into the temperature (Ti) of the inverter (140), so that the temperature sensor (103*a* or 103*b*) doubles as the temperature measurement means (103).

Accordingly, since the existing temperature sensor (103*a* or 103*b*) doubles as the temperature measurement means (103), it is unnecessary to provide a temperature measurement means (103) dedicated to the inverter (140). Therefore, it is possible to further reduce costs.

To be more specific, according to a third aspect of the invention, a motor protective temperature sensor (103*a*) for measuring a temperature of a heat generating portion of the motor section (110), or a discharge temperature sensor (103*b*) for measuring a discharge temperature of the refrigerant from the compressor (120), is properly used as the temperature sensor (103*a* or 103*b*).

Incidentally, the parenthesized numerals accompanying the foregoing individual means correspond with concrete means seen in the embodiments to be described later.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

(First Embodiment)

Figure 1:
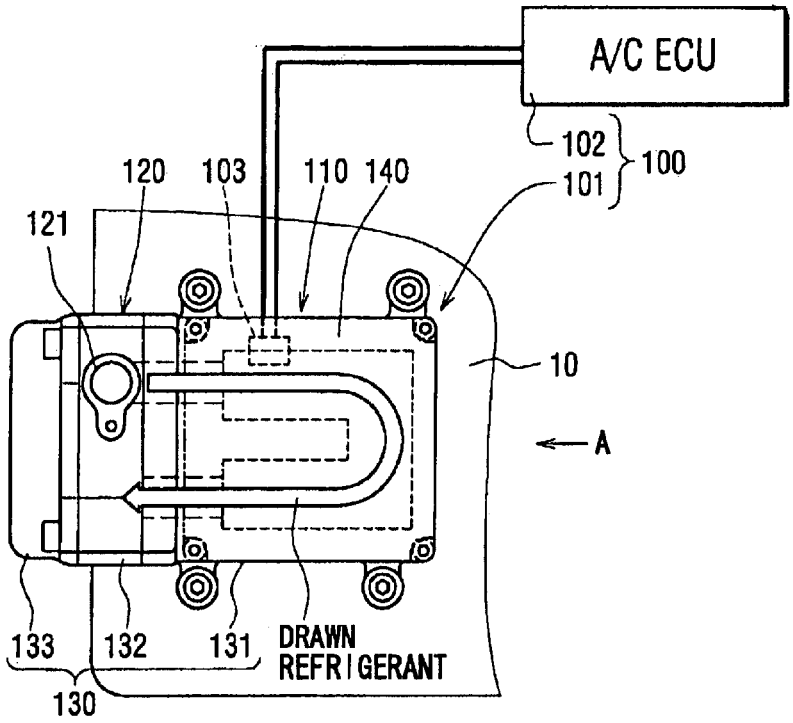
FIG. 1 is a schematic view showing the general configuration of an electric compression device according to a first embodiment of the present invention.
Figure 2:
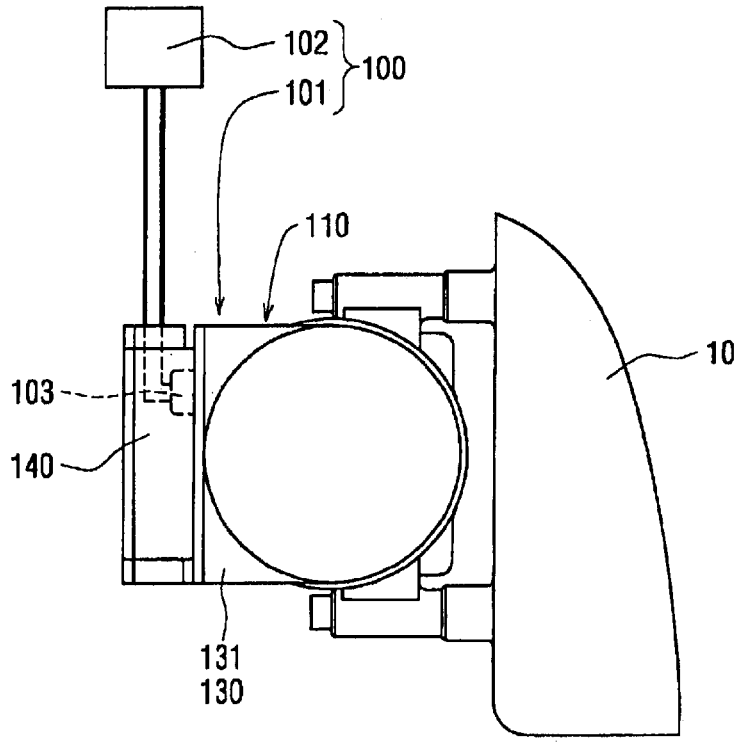
FIG. 2 is a side view of FIG. 1 in the direction of arrow A of FIG. 1.

A first embodiment of an electric compression device 100 according to the present invention will be hereinafter described with reference to FIGS. 1 to 4. The electric compression device 100 which is applied to a refrigeration cycle device for a vehicle, such as an automobile, is installed inside an engine compartment, and for example, fixed on an engine 10. The electric compression device 100, as shown in FIGS. 1 and 2, includes an electric compressor 101 and a control unit 102.

The electric compressor 101 has a motor section 110, compressor section 120, a housing 130, and an inverter 140. The housing 130, as an enclosed enclosure composed of a motor housing 131, a middle housing 132, and a rear housing 133, contains the motor section 110 and the compressor section 120. The inverter 140 is attached to the outer surface of the housing 130.

The motor section 110 has an alternating current three-phase motor contained in the motor housing 131. A rotation shaft of the motor is connected to the compressor section 120. The motor section 110 is driven by power, such as electric current, output from the inverter 140.

The compressor section 120, contained in the middle housing 132, is actuated in connection with the drive of the motor section 110 to compress the refrigerant in the refrigeration cycle system to a high-temperature and a high-pressure. The middle housing 132 is provided with a suction port 121 for drawing the refrigerant. The low-temperature and low-pressure refrigerant drawn from the suction port 121 flows through the motor section 110 in the motor housing 131 with a U-turn. Then, the refrigerant compressed in an operation chamber is discharged from a discharge port (not shown) via a discharge chamber provided in the rear housing 133.

The inverter 140, which is a well-known DC-to-AC inverter device, inverts direct current from a battery (not shown) into alternating current. The inverter 140 also varies an output amount of current to the motor section 110 in accordance with switching of a switching device provided inside the inverter 140 itself. The input of the switching device is connected to the battery and the control unit 102, and the output thereof is connected to the motor section 110. The inverter 140 is fixed to the outer surface of the motor housing 131 corresponding to an area in which the refrigerant flows with the U-turn.

The switching device of the inverter 140, or a base of the switching device is provided with a temperature sensor 103 as a temperature measurement means. Temperature measurement signals therefrom are input into the control unit 102.

A/C demand signals, environmental condition signals for cooling, and the like are input into the control unit 102. The control unit 102 regulates the output current of the inverter 140 on the basis of these signals, in order to control the drive of the motor section 110, namely the operation of the compressor section 120. As a feature of the present invention, the drive of the motor section 110 is controlled separately from the refrigeration cycle system on the basis of the temperature signals from the temperature sensor 103 of the inverter 140. The detail thereof will be described later.

The operation of the electric compression device 100 having the foregoing structure will be hereinafter described. Upon receiving the A/C demand signals, the control unit 102 calculates the heat load of the refrigeration cycle system from the environmental condition signals for cooling. Then, the control unit 102 regulates the output current from the inverter 140 on the basis of the heat load, in order to drive the motor section 110 and actuate the compressor section 120. The low-temperature and low-pressure refrigerant flowing into the housing 130 through the suction port 121 flows through the motor housing 131. Since the refrigerant cools the motor section 110 and the inverter 140, both of the motor section 110 and the inverter 140 can properly resist heat damage.

When the A/C demand signals are turned off, on the other hand, the motor section 110 stops operating and the refrigerant stops flowing. Generally, a cooling state in the vicinity of the inverter 140 is maintained at a cooling state which was brought by the refrigerant flowing through there when the compressor section 120 operated. However, when the vehicle is driven under high load conditions, such as when it is climbing a hill at a low speed, sitting in a traffic jam or the like, the radiation heat from the engine 10 or the engine compartment increases the temperature of the inverter 140. During these experiences, the temperature of the inverter 140 may exceed an allowable temperature. In the electric compression device 100 according to the present invention, the temperature is controlled to protect the inverter 140 even in such a case. The details of control will be hereinafter described with reference to a control flow chart shown in FIG. 3, and a timing chart shown in FIG. 4.

Figure 3:
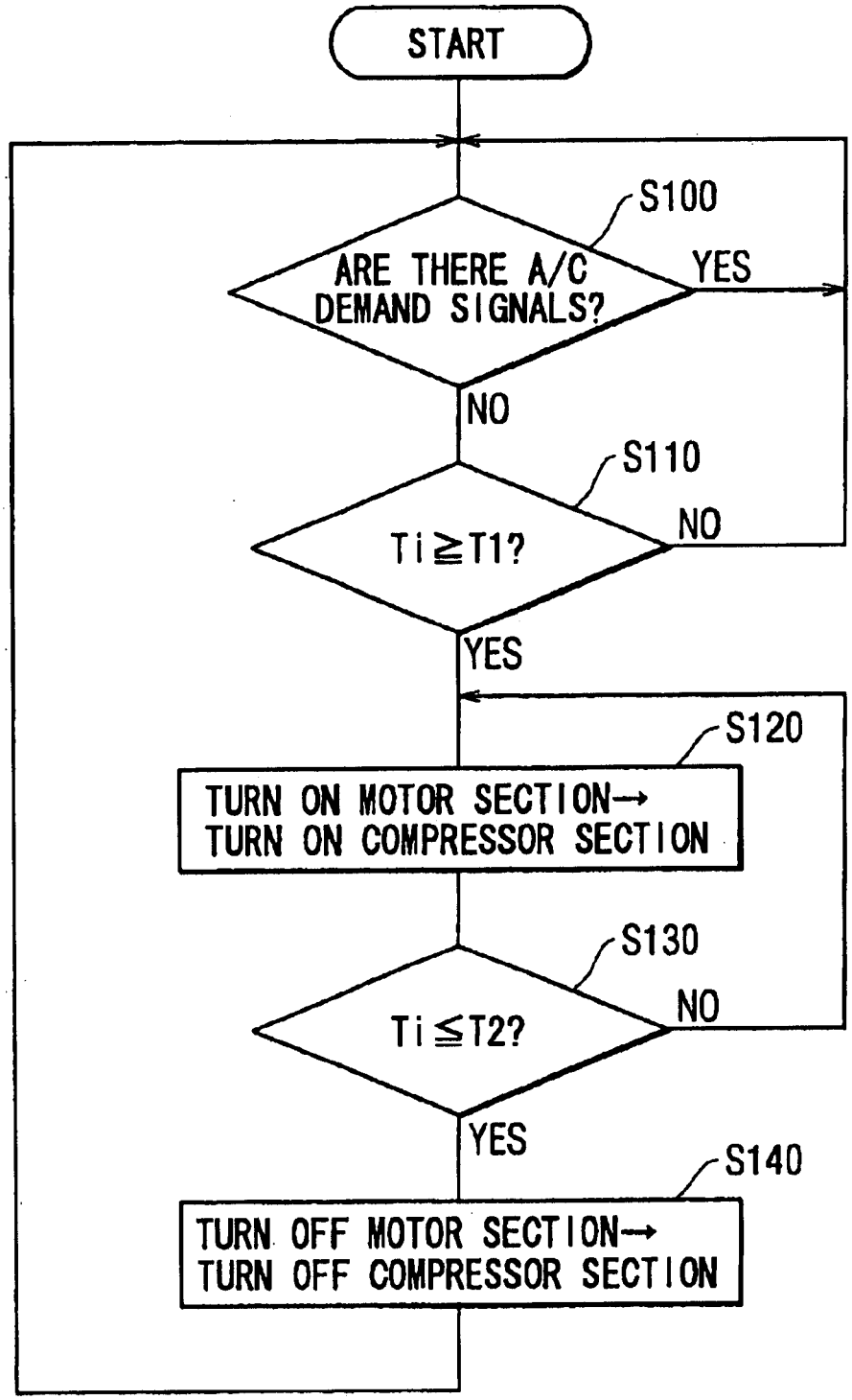
FIG. 3 is a control flow chart showing operation control processes of a motor section.
Figures 4A, 4B, 4C, 4D:
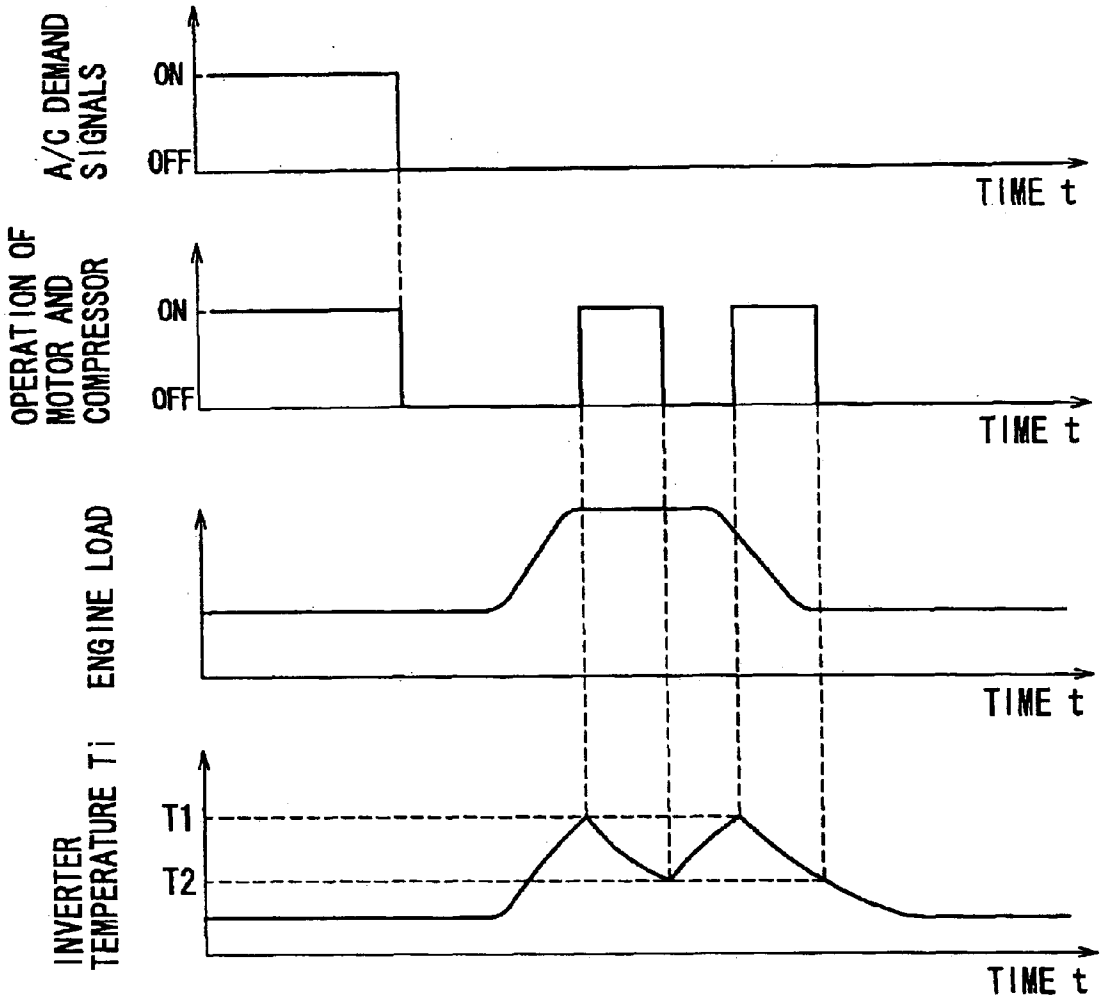
FIG. 4A is a timing chart showing A/C demand signals in FIG. 3.
FIG. 4B is a timing chart showing the operation of a motor and a compressor.
FIG. 4C is a timing chart showing an engine load.
FIG. 4D is a timing chart showing the inverter temperature.

Referring to FIG. 3, the presence or absence of the A/C demand signals is detected in step S100. If the A/C demand signals are present, the flow returns to start to control the refrigeration cycle system as usual. If the A/C demand signals are absent, whether the temperature Ti of the inverter 140 is higher than a first predetermined temperature T1 or not is judged in step S110. The first predetermined temperature T1, which corresponds to a predetermined temperature of the present invention, is predetermined as an allowable upper limit temperature of the inverter 140.

If the temperature Ti is lower than the first predetermined temperature T1 in step S110, the inverter 140 does not suffer heat damage, so that the flow returns to the start. If the temperature Ti is higher than the first predetermined temperature T1, on the other hand, the motor section 110 is driven separately from the refrigeration cycle system to actuate the compressor section 120 in step S120 (refer to FIGS. 4B and 4D).

Then, in step S130, it is determined whether the temperature Ti of the inverter 140 becomes lower than a second predetermined temperature T2, which is lower than the first predetermined temperature T1. If the temperature Ti becomes lower than the second predetermined temperature T2, the motor section 110 is stopped in step S140 to stop the compressor section 120. While "NO" is judged in step S130, the operation of the electric compression device 100 is continued in step S120.

As described above, the motor section 110 actuates the compressor section 120 in accordance with the temperature Ti of the inverter 140. Since the flowing refrigerant cools the inverter 140, the inverter 140 is unaffected by the heat damage caused by an increase in the environment temperature even if the engine 10 is under a high load. It is unnecessary to make the inverter 140 large, or to use an inverter having a higher resistance to heat, so that it is possible to reduce costs.

(Second Embodiment)

Figure 5:
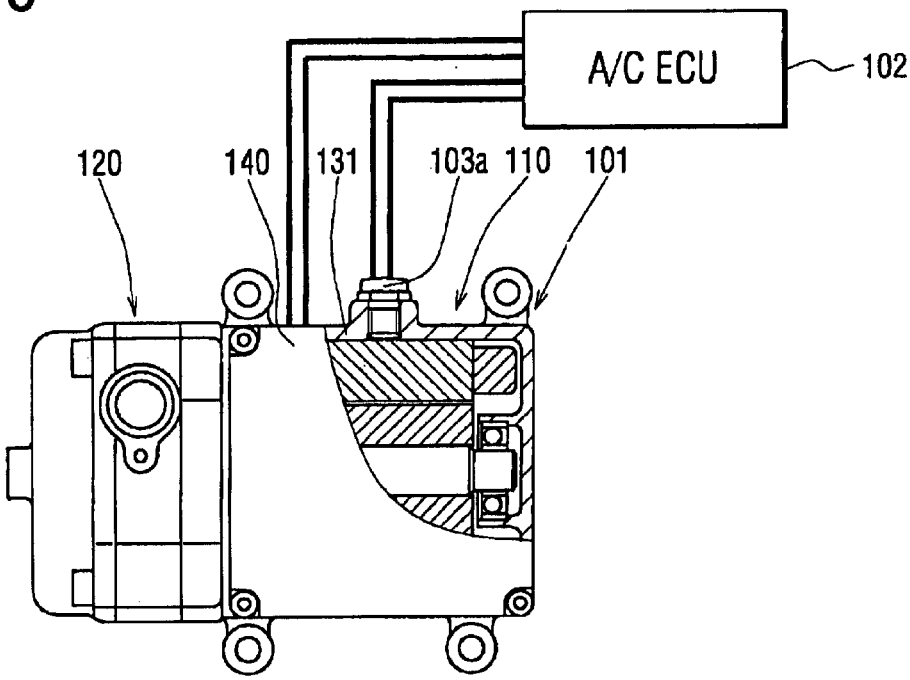
FIG. 5 is a schematic view showing the general configuration of an electric compression device according to a second embodiment.
Figure 6:
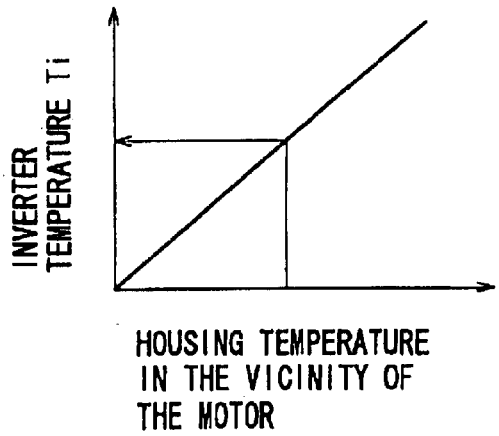
FIG. 6 is a graph showing the correlation between the housing temperature in the vicinity of the motor and the inverter temperature, in the electric compression device of FIG. 5.

FIGS. 5 and 6 show an electric compression device according to a second embodiment of the present invention. In the electric compression device of the second embodiment, the temperature sensor is changed as compared with the first embodiment.

In the second embodiment, the refrigeration cycle system is provided with a temperature sensor 103*a* for protecting a motor (hereinafter called a motor temperature sensor). The motor temperature sensor 103*a* measures the temperature of the motor section 110. When the temperature of the motor section 110 exceeds a predetermined allowable temperature, the output of the motor section 110 is controlled so as to protect the motor section 110. The motor temperature sensor 103*a* is provided in the motor housing 131 to which a heat generating portion of the motor section 110 is closest.

In the control unit 102, is stored a control characteristic (refer to FIG. 6) which shows a correlation between the temperature measured by the motor temperature sensor 103*a* in stopping the refrigeration cycle system, namely in stopping the motor section 110 (housing temperature in the vicinity of the motor), and the temperature Ti of the inverter 140.

Thus, converting the temperature measured by the motor temperature sensor 103*a* into the temperature Ti of the inverter 140, it is possible to control the motor 110 in such a manner as to be described in the first embodiment. In this case, the motor temperature sensor 103*a* is used as a temperature measurement means, so that it is unnecessary to provide a dedicated temperature sensor 103. Accordingly, it is possible to further reduce costs.

Figure 7:
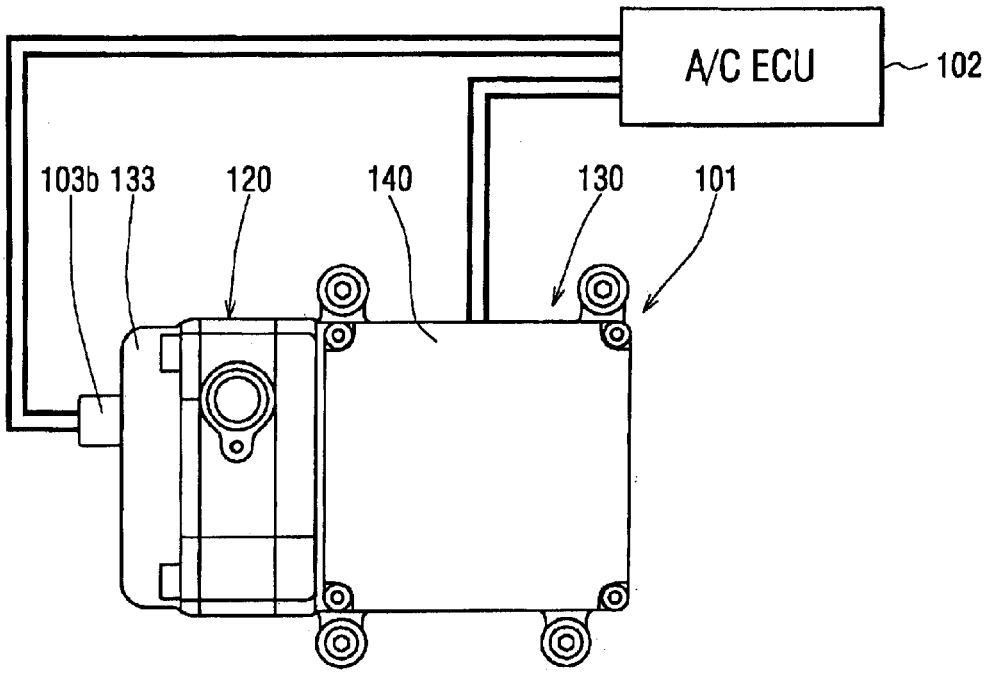
FIG. 7 is a schematic view showing the general configuration of the electric compression device according to a modified example of the second embodiment.
Figure 8:
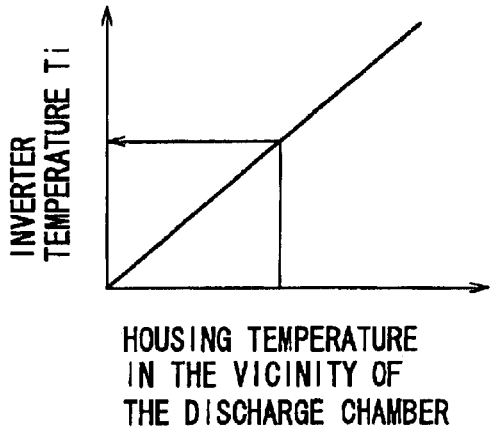
FIG. 8 is a graph showing the correlation between the housing temperature in the vicinity of the discharge chamber and the inverter temperature, in the electric compression device of FIG. 7.

In a case where the electric compression device 100 has a discharge temperature sensor 103*b* for measuring a discharge temperature of the refrigerant, the discharge temperature sensor 103*b* may also be used as the temperature sensor, as shown in FIG. 7. In this case, correlation between the discharge temperature and the temperature Ti of the inverter 140, shown in FIG. 8 as with FIG. 6, is determined in advance. The temperature Ti of the inverter 140 is obtained based on the correlation. The discharge temperature sensor 103*b* is provided in the rear housing 133 which is in the vicinity of the discharge chamber to measure the discharge temperature of the refrigerant. When the discharge temperature exceeds a predetermined allowable temperature, the output of the motor section 110 is so controlled as to protect a rubber tube, through which the refrigerant flows, from degradation by heat.

(Another Embodiment)

In the above embodiments, the electric compression device 100 is installed in a vehicular engine compartment, but it is not limited thereto. The electric compression device may be installed in a refrigeration cycle system of an electric train and the like.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. An electric compression device comprising:

a motor section driven by power output from an inverter;

a compressor section for compressing a refrigerant in a refrigeration cycle system, said compressor section being actuated by said motor section;

a control unit for regulating output power of said inverter to control drive of said motor section;

a housing for containing said motor section and said compressor section;

the inverter being attached to an outer surface of said housing;

temperature measurement means for measuring a temperature of said inverter, wherein in a stop state of said refrigeration cycle system, said control unit drives said motor section, when the temperature of said inverter measured by said temperature measurement means exceeds a predetermined temperature.

2. The electric compression device according to claim 1, wherein said housing is provided with a temperature sensor for measuring a temperature of said motor section or a temperature of said compressor section, said control unit converts the temperature measured by said temperature sensor into the temperature of said inverter, so that said temperature sensor doubles as said temperature measurement means.

3. The electric compression device according to claim 2, wherein said temperature sensor is any one of a motor protective temperature sensor for measuring a temperature of a heat generating portion of said motor section, and a discharge temperature sensor for measuring a discharge temperature of said refrigerant from said compressor section.

* * * * *